US007105227B2

(12) United States Patent
Yasuda et al.

(10) Patent No.: US 7,105,227 B2
(45) Date of Patent: Sep. 12, 2006

(54) FLAME-RETARDANT LEATHER-LIKE SHEET BASE AND PROCESS FOR PRODUCING THE SAME

(75) Inventors: Yoshiaki Yasuda, Kurashiki (JP); Yasuhiro Takeda, Kurashiki (JP); Shuhei Ishino, Kurashiki (JP); Yoshihiro Tanba, Kurashiki (JP)

(73) Assignee: Kuraray Co., Ltd., Kurashiki (JP)

( * ) Notice: Subject to any disclaimer, the term of this patent is extended or adjusted under 35 U.S.C. 154(b) by 95 days.

(21) Appl. No.: 10/399,402

(22) PCT Filed: Feb. 18, 2002

(86) PCT No.: PCT/JP02/01359

§ 371 (c)(1),
(2), (4) Date: Apr. 22, 2003

(87) PCT Pub. No.: WO02/081813

PCT Pub. Date: Oct. 17, 2002

(65) Prior Publication Data

US 2005/0101205 A1 May 12, 2005

(30) Foreign Application Priority Data

Mar. 30, 2001 (JP) ..... 2001-099083

(51) Int. Cl.
*B23B 9/00* (2006.01)
*D04H 13/00* (2006.01)

(52) U.S. Cl. ..... 428/365; 428/368; 428/370; 428/375; 428/904; 442/334; 442/340; 442/374; 442/375; 442/376; 442/380

(58) Field of Classification Search ..... 428/151, 428/364, 365, 375, 368, 370, 904; 442/334, 442/340, 344, 375, 376, 380
See application file for complete search history.

(56) References Cited

U.S. PATENT DOCUMENTS

| | | | | |
|---|---|---|---|---|
| 4,476,186 | A * | 10/1984 | Kato et al. | 442/60 |
| 5,308,692 | A * | 5/1994 | Kennedy et al. | 442/415 |
| 5,389,716 | A * | 2/1995 | Graves | 524/510 |
| 5,503,899 | A | 4/1996 | Ashida et al. | |
| 5,876,466 | A | 3/1999 | Nakashima et al. | |
| 6,159,581 | A | 12/2000 | Yoneda et al. | |
| 6,322,581 | B1 | 11/2001 | Fukuda et al. | |
| 6,451,404 | B1 | 9/2002 | Nobuto et al. | |
| 6,479,153 | B1 | 11/2002 | Kato et al. | |
| 6,517,938 | B1 | 2/2003 | Andoh et al. | |
| 6,767,853 | B1 * | 7/2004 | Nakayama et al. | 442/361 |
| 6,900,148 | B1 * | 5/2005 | Yoneda et al. | 442/341 |
| 2003/0065105 | A1 * | 4/2003 | Kato et al. | 525/418 |

FOREIGN PATENT DOCUMENTS

| | | | |
|---|---|---|---|
| JP | 63-42981 | | 2/1988 |
| JP | 63-85185 | | 4/1988 |
| JP | 63085185 | * | 4/1988 |
| JP | 2000-355885 | | 12/2000 |

OTHER PUBLICATIONS

U.S. Appl. No. 09/639,107, filed Aug. 16, 2000, Nobuto et al.
U.S. Appl. No. 09/755,124, filed Jan. 8, 2001, Nobuto et al.
U.S. Appl. No. 10/186,627, filed Jul. 2, 2002, Yoneda et al.

* cited by examiner

*Primary Examiner*—Norca Torres
*Assistant Examiner*—Matthew D. Matzek
(74) *Attorney, Agent, or Firm*—Oblon, Spivak, McClelland, Maier & Neustadt, P.C.

(57) ABSTRACT

The leather-like sheet substrate of the invention comprises a nonwoven fabric of three-dimensionally entangled superfine fibers (A) of at most 0.5 dtex in fineness and a polymer elastomer (B) filled in the entangled interspaces of the nonwoven fabric, in which the superfine fibers (A) comprise an organophosphorus component-copolymerized polyester and the polymer elastomer (B) contains a metal hydroxide or is copolymerized with an organophosphorus component.

The leather-like sheet substrate of the invention and artificial leather obtained from it contain no halogen and are resistant to flames. These have a soft feel and are suitable to applications in the interior field that requires flame retardancy, especially to seats for vehicles, etc.

15 Claims, No Drawings

FLAME-RETARDANT LEATHER-LIKE SHEET BASE AND PROCESS FOR PRODUCING THE SAME

TECHNICAL FIELD

The present invention relates to a halogen-free, flame-retardant leather-like sheet substrate of good flame retardancy, which is suitable to applications in the field of interior decoration, especially to those requiring flame retardancy such as seats for vehicles, etc., and which comprises superfine polyester fibers and a polymer elastomer and has a soft feel.

BACKGROUND ART

Because of their good dimensional stability, weather resistance, mechanical properties and durability, synthetic fibers especially polyester fibers, polyamide fibers, etc. are heretofore indispensable for the materials for clothing, interior decoration, etc. Depending on their use, however, the fibers are required to have some additional specific functions. For example, for the fibers in the field of interior decoration, especially in the field of artificial leather for the facing materials for seats for railroad coaches, seats for automobiles, seats for airplanes, etc., it is extremely important to be resistant to flames.

Heretofore, a substrate of nonwoven fabric that has a binder of a polymer elastomer in the interspaces of entangled fibers therein is used for the substrate layer for artificial leather. When the surface of the substrate is coated with a resin layer, it gives grain-leather-like artificial leather; and when napped, it gives suede-like artificial leather. For making the artificial leather substrate layer resistant to flames, generally employed are a method of adhering a flame retardant to the surfaces of the fibers and the binder that constitute the substrate layer, through post-treatment or the like; a method of lining the back of the substrate layer with a flame-retardant sheet; a method of using fibers spun from a thermoplastic polymer kneaded with flame-retardant particles thereinto, etc.

Of those methods, the method comprising such post-treatment is problematic in that the feel of the artificial leather produced is not good and, especially when the artificial leather is a suede-like one having a napped surface, its dense naps pill through the post-treatment for flame retardancy and the surface pills worsen the appearance of the suede-like artificial leather. On the other hand, the method of lining the back of the substrate layer with a flame-retardant sheet is also problematic in that there often occurs a difference of the flame retardancy between the face and the back and the feel of the artificial leather thus produced is not good.

One concrete embodiment generally employed for the method of kneading a thermoplastic polymer for fibers with a flame retardant thereinto comprises kneading a flame retardant having an active ingredient of a phosphorus or halogen compound into a shaping material such as polyethylene, polypropylene, polyethylene-polypropylene copolymer, polystyrene, etc., to thereby make the resulting polymer fibers resistant to flames. On the other hand, the method of kneading the flame retardant into a polyamide-type polymer such as nylon 6, nylon 66, nylon 610, etc., or into a polyester-type polymer such as polyethylene terephthalate, polytrimethylene terephthalate, polybutylene terephthalate, etc. is problematic in that the spinning temperature must be specifically controlled and the polymer and the flame retardant to be used must be specifically selected from the viewpoint of the stability of the flame retardant and the polymer at the melt-spinning temperature and the method gives low productivity.

Still another problem with the method of kneading a flame retardant to the fibers is that the method is applicable to flame-retardant fibers having a regular fineness, or that is those thicker than 0.5 dtex in fineness, but could not to superfine fibers. In this connection, for example, for suede-like artificial leather for which the fineness of the fibers is a matter of importance, the fineness of the fibers constituting it is preferably at most 0.5 dtex for raising a dense and high-quality fibrous nap on it and for making it have a good feel, and for further making it have a natural leather-like excellent appearance. However, when flame-retardant particles are kneaded into such superfine fibers, then the physical properties of the fibers greatly worsen because of the relationship between the particle size of the flame-retardant particles and the area of the cross section of each fiber, and, as a result, the resulting artificial leather made of such fibers could be no more practicable.

Even when a flame-retardant organic substance or the like could be dispersed in such superfine fibers not worsening the physical properties of the fibers, the flame-retardant organic substance will drop off from the fibers in the subsequent wet treatment of forming the binder into a porous substrate through solvent removal for coagulation; or for a sheet of superfine fibers-forming fibers, especially those having a sea-island structure, the flame-retardant organic substance will also drop off from the fibers in the step of removing the sea component from the fibers that is generally employed in forming the intended superfine fibers. In most cases, therefore, the substrate or the sheet produced could not attain the intended flame retardancy level.

Even when superfine fibers are produced through direct spinning or the like and when an organic flame retardant is applied thereto, the flame retardant will bleed out on the surfaces of the fibers. If so, while the products of the fibers are used, the flame retardant will also bleed out on their surfaces. In particular, when they are used for seats for vehicles, the flame retardant thus having bled out on their surfaces will vaporize to often cause a problem of windshield or windowpane fogging, etc.

On the other hand, the flame retardant that may be dispersed in a polymer elastomer in producing a flame-retardant leather-like sheet substrate may be any known flame retardant for ordinary resins including, for example, halogen, phosphorus or nitrogen-containing organic flame retardants, and inorganic compounds such as metal hydroxides, red phosphorus, silicon compounds, etc. Anyhow, the requirements for the flame retardant are that it does not promote the degradation of the polymer elastomer and the superfine fibers to which it is applied, and it does not substantially dissolve and decompose in the coagulation bath to be used in producing the intended leather-like sheets and also in the processing solutions to be used in the step of forming the superfine fibers, etc. On the other hand, in case where the leather-like sheets produced contain a halogen substance, they release harmful substances such as dioxins, etc. when they are fired, and will give some load to the environmental problem.

The object of the invention is to provide a halogen-free and durable flame-retardant leather-like sheet substrate having a soft feel, which is produced by imparting flame retardancy to superfine fibers having a single-fiber fineness of at most 0.5 dtex, preferably those obtained through removal of at least one component from conjugate or mixed spun fibers of at least two or more components of thermoplastic polymers, not so much worsening the properties of the resulting superfine fibers, and by imparting flame retardancy also to the polymer elastomer to be in the substrate not promoting the degradation of the polymer elastomer.

DISCLOSURE OF THE INVENTION

And so, the present inventors have assiduously studied halogen-free, flame-retardant leather-like sheets, and have reached the present invention.

Specifically, the invention provides a flame-retardant leather-like sheet substrate, which comprises a nonwoven fabric of three-dimensionally entangled superfine fibers (A) of at most 0.5 dtex in fineness and a polymer elastomer (B) filled in the nonwoven fabric, and in which the superfine fibers (A) comprise an organophosphorus component-copolymerized polyester and the polymer elastomer (B) satisfies at least one of the following (1) or (2):

(1) the polymer elastomer (B) contains a metal hydroxide;

(2) the polymer elastomer (B) is copolymerized with an organophosphorus component.

The invention also provides a method for producing a flame-retardant leather-like sheet substrate that comprises a nonwoven fabric of three-dimensionally entangled superfine fibers (A) of at most 0.5 dtex in fineness and a polymer elastomer (B) filled in the nonwoven fabric; the method comprising the following steps <1> to <3> to be effected in a order of <1>, <2> and <3> or a order of <1>, <3> and <2>:

<1> a step of preparing a fibers-entangled nonwoven fabric that comprises superfine fibers-forming fibers capable of giving superfine fibers of an organophosphorus component-containing polyester, <2> a step of applying to the nonwoven fabric a polymer elastomer (B) that contains a metal hydroxide or is copolymerized with an organophosphorus component, <3> a step of converting the superfine fibers-forming fibers into bundles of superfine fibers (A) having a single-fiber fineness of at most 0.5 dtex.

BEST MODES OF CARRYING OUT THE INVENTION

In the production method, the bundles of superfine fibers having a single-fiber fineness of at most 0.5 dtex may be prepared in any known conventional process. For example, they can be obtained as follows: From superfine fibers-forming fibers which comprise at least two different types of polymers less compatible with each other and in which at least one polymer forms an island component and the other at least one polymer forms a sea component in their cross sections, at least one component (in general, the sea component polymer) is removed through dissolution or decomposition; or pasted, superfine fibers-forming fibers having a cross-sectional profile of at least two different types of polymers less compatible with each other being bonded to each other are mechanically or chemically processed to thereby peel the two components at their interface and to decompose or remove at least one component therein.

In order that the superfine fibers that constitute the superfine-fiber bundles formed in the process may have a single-fiber fineness of at most 0.5 dtex, preferably at most 0.2 dtex, the superfine fibers-forming fibers of which the cross sections have a sea-island structure are preferred to the pasted, superfine fibers-forming fibers in view of the productivity of the superfine fibers in the process. In case where the single-fiber fineness of the constituent superfine fibers used is at least 0.05 dtex or so and where the leather-like sheet substrate comprising them has a good appearance and high quality, the superfine fibers of the type may be directly prepared in a direct spinning process not requiring the step of forming superfine fibers through fiber component extraction or interfacial peeling treatment, or the nonwoven fabric comprising the superfine fibers may be prepared in a process not requiring the extraction step.

The above-mentioned steps <1> to <3> are only the indispensable steps of preparing the superfine fibers-forming fibers for the leather-like sheet substrate of the invention. Therefore, the method of the invention may include any other steps than these <1> to <3>. For example, after the step <1> the nonwoven fabric prepared may be thermally pressed, or may be pre-set with a size such as typically polyvinyl alcohol.

In the invention, when the superfine fibers are prepared from sea-island structured fibers, they may be obtained through conjugate spinning or mixed spinning of at least two different types of thermoplastic polymers of less compatibility with each other. In order that the superfine fiber bundles obtained through removal of the sea component from the sea-island structured fibers are made resistant to flames, the resin for the island component shall be made resistant to flames.

In general, for making fibers themselves resistant to flames (not through post-treatment), employable is a method of kneading a flame retardant of inorganic compounds, organic halogen compounds, halogen-containing organophosphorus compound, organophosphorus compounds, etc. into the fibers while they are spun. However, this is problematic in that the reactivity of the flame retardant is lowered, the physical properties of the fibers are lowered, etc. Another problem with the method for producing superfine fibers is that the flame retardant often drops off while the sea component polymer is removed from the fibers. Halogen compounds are effective for making fibers have good flame retardancy but are problematic in that they give substances harmful to human bodies, for example, dioxins, when fired. Therefore, halogen compounds are not favorable for a method of making artificial leather for seats for vehicles resistant to flames.

To solve all these problems and to make superfine fibers resistant to flames, an organophosphorus component-copolymerized resin is used for the island component of sea-island structured fibers to be processed in the invention. For such an organophosphorus component-copolymerized resin, known are resins of cellulose, polyester, phenol, etc. copolymerized with an organophosphorus component. In the invention, used are organophosphorus component-copolymerized polyesters as they are melt-spinnable and they satisfy the necessary physical properties for artificial leather. For example, herein usable are known organophosphorus component-copolymerized polyesters such as those described in JP-A-51-82392 and JP-A-55-7888 and JP-B-55-41610. Methods for producing such organophosphorus component-copolymerized polyesters are not specifically defined. For example, employable is a method of transesterification of dicarboxylic diesters with diols in which an organophosphorus compound is added to the transesterification system; a method of polycondensation with adding an organophosphorus compound to the reaction system before the start of the reaction or in the initial stage of the reaction; or a method of esterification of dicarboxylic acids with diols in which an organophosphorus compound is added to the reaction system in any stage of esterification.

The organophosphorus compound to be used for the reaction includes oxaphospholane, phosphinic acid derivatives, phosphaphenanthrene derivatives, etc. such as those mentioned in the above-mentioned patent publications. Above all, a phosphaphenanthrene derivative of the following chemical formula I is the most favorable phosphorus atom-containing compound.

(I)

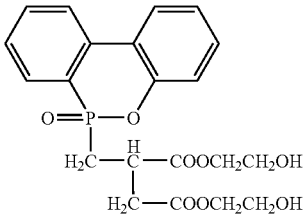

For the matrix polyester, usable are known polyesters such as polyethylene terephthalate, polytrimethylene terephthalate, polybutylene terephthalate, etc. and their modified polymers, mixed polymers, copolymers, etc.

Organophosphorus component-copolymerized polyethylene terephthalate-type polyesters are favorable to the invention as they give leather-like sheets having the advantage of good flame retardancy resulting from the organophosphorus component therein and the advantage of excellent mechanical properties and good dyeability resulting from the polyethylene terephthalate-type polyester matrix.

Organophosphorus component-copolymerized polytrimethylene terephthalate-type polyesters are also favorable to the invention as they give leather-like sheets having the advantage of good flame retardancy resulting from the organophosphorus component therein and the advantage of soft feel and good dyeability resulting from the polytrimethylene terephthalate-type polyester matrix.

In producing the organophosphorus component-copolymerized, polyethylene terephthalate-type and polytrimethylene terephthalate-type polyesters for use in the invention, the essential acid component may be terephthalic acid and the essential glycol component may be ethylene glycol for polyethylene terephthalate-type polyesters and trimethylene glycol for polytrimethylene terephthalate-type polyesters, and, if desired, these essential components may be optionally further copolymerized with one or more other dicarboxylic acid components, hydroxycarboxylic acid components and glycol components that constitute additional copolymer units in the copolyesters. In that case, the additional dicarboxylic acid component includes aromatic dicarboxylic acids such as diphenyldicarboxylic acid, naphthalenedicarboxylic acid, etc., or their ester-forming derivatives; metal sulfonate group-containing aromatic carboxylic acids such as dimethyl-5-sodiumsulfoisophthalate, bis(2-hydroxyethyl)-5-sodiumsulfoisophthalate, etc., or their derivatives; and aliphatic dicarboxylic acids such as oxalic acid, adipic acid, sebacic acid, dodecane-diacid, etc., or their ester-forming derivatives. Examples of the hydroxycarboxylic acid component are p-hydroxybenzoic acid, p-β-hydroxyethoxybenzoic acid or their ester-forming derivatives, etc. The glycol component includes aliphatic diols such as diethylene glycol, 1,4-butanediol, 1,6-hexanediol, neopentyl glycol, etc.; and 1,4-bis(β-hydroxyethoxy)benzene, polyethylene glycol, polybutylene glycol, etc.

The essential acid component of terephthalic acid referred to herein is meant to indicate that terephthalic acid accounts for from 50 mol % to 100 mol %, preferably from 80 mol % to 100 mol % of the acid component; and the essential glycol component of trimethylene glycol is meant to indicate that trimethylene glycol accounts for from 50 mol % to 100 mol %, preferably from 80 mol % to 100 mol % of the glycol component.

Still another advantage of the organophosphorus component-copolymerized polyesters when used in the invention is that they are free from the trouble of flame retardant dropping, etc. in the spinning process to form fibers and even in the subsequent process of forming the fibers into artificial leathers, since the phosphorus component is copolymerized with the polymer matrix in the copolyesters, or that is, it is bonded to the polymer matrix through covalent bonding between them.

In addition, these copolyesters are free from the problem with halogen-containing compounds of which the use is undesirable in the recent environmental situation. Preferably, the resins of the organophosphorus component-copolymerized polyesters could fully reinforce the physical properties of fibers containing them. In addition, when they are applied to sea-island structured fibers, it is desirable that their melt viscosity is larger than that of the sea component polymer of the fibers and their surface tension is smaller than that thereof under spinning conditions, and they are spinnable in melt. For example, it is desirable that the copolyester resins have a melt flow rate of from 5 g/10 min to 50 g/10 min, measured at a spinning temperature through an orifice having a diameter of 2 mmϕ and under a load of 325 g, and the mechanical strength of the fibers comprising them falls between 1.0 g/dtex and 5.0 g/dtex.

Preferably, the phosphorus atom concentration in the organophosphorus component-copolymerized polyesters falls between 3000 ppm and 20000 ppm, more preferably between 5000 ppm and 150000 ppm. If it is smaller than 3000 ppm, the leather-like sheet substrate containing the copolyester could not be satisfactorily resistant to flames; but if larger than 20000 ppm, the viscosity of the copolyester resin will lower and therefore the physical properties of the fibers containing the copolyester resin will be poor and the spinnability of the fibers will also be poor. In that condition, anyhow, the productivity of the fibers will be low, and the copolyester resin of the type will be unfavorable for the fibers.

On the other hand, the sea component polymer shall differ from the island component polymer in point of the solubility and degradability in solvents and decomposing agents (concretely, the solubility or the degradability of the sea component polymer shall be larger than that of the island component polymer), and this is a resin less compatible with the island component polymer. For example, it is at least one polymer selected from polyethylene, polystyrene, polyethylene-polypropylene copolymer, modified polyesters copolymerized with sodium sulfoisophthalate, etc. For example, polystyrene and polyethylene are readily extractible with toluene or trichlene; and modified polyesters such as sodium sulfoisophthalate-copolymerized polyethylene terephthalate, etc. can be removed through decomposition with alkali. From the sea-island structured fibers, the sea component is removed through extraction or decomposition, whereby the sea-island structured fibers can be converted into superfine fiber bundles.

In the invention, the sea-island structured fibers may be such that the sea component thereof is divided into multiple portions by the island component in the cross section of each fiber. For example, in the cross section of each fiber of the type, the sea component and the island component may form layers to give a multilayer-pasted configuration.

As the case may be, the island component may be continued in the direction of the fiber length with no intermittence therein, or may be discontinued.

The number of islands in the cross sections of the sea-island structured fibers is not specifically defined, but must be so controlled that the superfine fiber bundles converted from the sea-island structured fibers have a single-fiber fineness of at most 0.5 dtex. For producing the sea-island structured fibers for use in the invention, employable are various melt-spinning methods (chip-blending method, needle-piping method, pasting method, etc.).

The ratio of the sea component to the island component to constitute the sea-island structured fibers for use in the invention preferably falls between 8/2 and 2/8 by weight, in view of the balance of the physical properties and the good feel of the leather-like sheet substrate to be obtained herein.

In the invention, the mean fineness of the superfine fibers of the superfine fiber bundles to be formed after removal of the sea component polymer from the sea-island structured fibers must be indispensably at most 0.5 dtex, as so mentioned hereinabove, and its lowermost limit is preferably 0.001 dtex. Especially in consideration of the balance of the physical properties and the feel of the leather-like sheet substrate of the invention, the mean fineness of the superfine fibers preferably falls between 0.01 dtex and 0.3 dtex. If desired, the island component of the fibers may contain colorants such as dye, pigment, etc., and various stabilizers, etc.

In the invention, the polymer elastomer that serves as a binder must be resistant to flames. For this, concretely, the polymer elastomer must be processed in at least one of the following two methods.

(1) The polymer elastomer is processed to contain a metal hydroxide;

(2) The polymer elastomer is copolymerized with an organophosphorus component.

Preferred examples of the metal hydroxide for (1) are hydroxides of at least one metal selected from the group consisting of aluminium and magnesium. Concretely, the metal hydroxide includes aluminium hydroxide and magnesium hydroxide; and aluminium hydroxide is more preferred.

For impregnating the polymer elastomer to the fibers-entangled nonwoven fabric, employable are any known methods, for example, a wet-coagulation method of dipping the nonwoven fabric in a liquid composition bath containing the polymer elastomer followed by further dipping the resulting nonwoven fabric in a coagulation bath to thereby solidify the polymer elastomer in the nonwoven fabric, or a dry-coagulation method of impregnating an emulsion of the polymer elastomer followed by thermally gelling the emulsion in the nonwoven fabric.

For incorporating the flame retardant into the polymer elastomer, the flame retardant may be dispersed in the liquid composition in which the nonwoven fabric is to be dipped. The metal hydroxide content of the polymer elastomer preferably falls between 10 parts by weight and 200 parts by weight relative to 100 parts by weight of the polymer elastomer, more preferably between 30 parts by weight and 100 parts by weight relative to 100 parts by weight of the polymer elastomer. If the metal hydroxide content is smaller than 10 parts by weight, the leather-like sheet substrate containing the polymer elastomer could not be satisfactorily resistant to flames; but if larger than 200 parts by weight, the polymer elastomer could not satisfactorily hold the metal hydroxide therein and, in addition, the polymer elastomer will often lose its flexibility.

Metal hydroxide particles having a smaller particle size (that is, those having a larger surface area per the unit weight) are more effective for flame retardation. However, in consideration of the dispersion stability of the particles in the liquid in which the nonwoven fabric is to be dipped, the metal hydroxide for use in the invention is preferably in the form of fine particles having a mean particle size of from 0.1 μm to 20 μm, more preferably from 0.5 μm to 3 μm.

If desired, the metal hydroxide particles for use herein may be processed in any desired manner for improving their moisture resistance, heat resistance, water resistance, acid resistance, etc.

For the polymer elastomer to which the metal hydroxide is to be added, herein usable are, for example, polyurethanes that are prepared through reaction of at least one polymer diol selected from diols such as polyester diols, polyether dials, polycarbonate diols and the like having a mean molecular weight of from 500 to 3000, or composite diols such as polyester-polyether diols, etc., at least one diisocyanate selected from aromatic, alicyclic or aliphatic diisocyanates such as 4,4'-diphenylmethane diisocyanate, isophorone diisocyanate, hexamethylene diisocyanate, etc., and at least one low-molecular compound having two or more active hydrogen atoms such as ethylene glycol, isophoronediamine, etc., in a predetermined molar ratio, and their modified derivatives. In addition to these, also usable are any other known polymer elastomers such as polyester elastomers, hydrogenated styrene-isoprene block copolymer elastomers, as well as acrylic resins, etc. If desired, these may be mixed to give a polymer composition for the polymer elastomer for use herein. However, in view of their flexibility, elasticity recoverability, porous polymer elastomer formability, durability, etc., preferred for use herein are polyurethanes mentioned above.

In the method (2) of copolymerizing the polymer elastomer with an organophosphorus component, the phosphorus atom concentration in the copolymerized polymer elastomer is preferably falls between 3000 ppm and 20000 ppm, more preferably between 5000 ppm and 20000 ppm. If the phosphorus atom concentration is smaller than 3000 ppm, the leather-like sheet substrate containing the copolymerized polymer elastomer could not be satisfactorily resistant to flames; but if larger than 20000 ppm, the leather-like sheet substrate could not satisfy the necessary physical properties.

The organophosphorus component to be copolymerized with the polymer elastomer may be any known phosphate esters, organic phosphine compounds, etc. In consideration of its influence on the polymer elastomer that may be degraded through hydrolysis with it, preferred for the organophosphorus component are organic phosphine compounds. Of organic phosphine compounds, difunctional compounds are preferred to trifunctional compounds as hardly gelling in reaction.

As so mentioned hereinabove, any known polymer elastomer may be copolymerized with an organophosphorus component, for which, however, preferred are polyurethanes as their properties including flexibility, elastic recovery, porous polymer elastomer formability, durability, etc. are good. Any known polyurethanes mentioned above are employable herein. Of those, however, preferred are polyether polyurethanes and polycarbonate polyurethanes in view of their hydrolysis-resistant stability. More preferred are polycarbonate polyurethanes.

Polyether or polyester polyurethanes are effective for retaining the flame retardancy of leather-like sheet substrates immediately after their production, but as compared with polycarbonate polyurethanes, their stability in hot water is poor. For example, when the leather-like sheet substrates containing polyether or polyester polyurethanes are dyed or washed, they will soon lose their flame retardancy as the polyurethanes therein will be readily hydrolyzed through the treatment. Therefore, in case where the leather-like sheet substrates are used in the sites not so much requiring good durability, using polyether or polyester polyurethanes would not lead to any serious problem. On the other hand, polycarbonate polyurethanes significantly retard the deterioration of the leather-like sheet substrates containing them, and therefore the leather-like sheet substrates containing polycarbonate polyurethanes are favorable to the sites that require high-level durability.

In the polycarbonate polyurethanes for use herein, preferably, polycarbonate diols account for from 50% to 100%, more preferably from 70% to 100% of the polymer diols constituting the polyurethane moiety. Accordingly, in case where such polycarbonate polyurethanes are preferably used for the polymer elastomer in the invention, the polymer elastomer may be composed of polycarbonate polyurethanes alone or may be a mixture of polycarbonate polyurethanes with any other polymer elastomers. Preferably, however, polycarbonate polyurethanes account for from 50% to 100% of the polymer elastomer in the invention. Typical examples of the other polymer elastomers are polyurethanes except polycarbonate polyurethanes, polyester elastomers, hydrogenated styrene-isoprene block copolymers and the like polymer elastomers, and acrylic resins, etc.

Organophosphorus component-copolymerized polycarbonate polyurethanes preferred for use in the invention can be prepared, for example, according to the polyurethane production process that comprises the following steps:

<1> An intermediate diol is obtained through reaction of at least one polymer diol of which the essential component is a known carbonate such as polyhexamethylene carbonate, etc., with at least one diisocyanate selected from aromatic, alicyclic or aliphatic diisocyanates such as 4,4'-diphenylmethane diisocyanate, isophorone diisocyanate, hexamethylene diisocyanate, etc.

<2> The intermediate diol obtained in <1> is chain-extended into a polymer by adding thereto at least one low-molecular compound having at least two active hydrogen atoms therein, such as ethylene glycol, isophoronediamine, etc., and at least one diisocyanate selected from aromatic, alicyclic or aliphatic diisocyanates such as 4,4'-diphenylmethane diisocyanate, isophorone diisocyanate, hexamethylene diisocyanate, etc.

In the process, a phosphorus-containing diol such as n-butyl-bis(3-hydroxypropyl)phosphine oxide, n-butyl-(2-hydroxy-1-methylethyl)-3-hydropropyl phosphine oxide, n-butyl-bis(2-hydroxy-1-methylethyl)phosphine oxide, etc., is used as a part of the polymer diol in the step (1), or as a part of the active hydrogen atom-having low-molecular compound in the step (2), or both in the two steps (1) and (2).

Needless-to-say, the phosphorus-containing diol may be introduced into the reaction system in any stage of reaction so far as the phosphorus atom concentration in the final polyurethane falls within the preferred range of at least 3000 ppm. Anyhow, introducing the phosphorus-containing diol into the reaction system in any stage of reaction gives polyurethanes favorable for use in the flame-retardant leather-like sheet substrate of the invention. Apart from the starting materials for the organophosphorus component-copolymerized polyurethanes, any other phosphorus-containing compounds may be used in any known one-shot process or prepolymer process to give the intended polyurethanes, so far as they do not significantly detract from the reactivity and the physical properties of the polyurethanes obtained in the process. Naturally, in that case, the phosphorus atom concentration in the compound mixture shall be the sum total thereof both in the organophosphorus component-copolymerized polyurethane and the additional phosphorus-containing compound, and its preferred range shall also be at least 3000 ppm as in the above.

Next described is the method for producing the flame-retardant leather-like sheet substrate of the invention in which are used sea-island structured fibers favorable to the invention.

The production method of the invention is described in detail. First prepared are superfine fibers-forming, sea-island structured fiber stables according to the known method mentioned above of using an organophosphorus component-copolymerized polyester for the island component. Regarding their size, the fibers preferably have a fineness of from 1.0 dtex to 10.0 dtex for ensuring good card-traveling capability, more preferably from 3.0 dtex to 6.0 dtex.

Next, the sea-island structured fiber staples are opened in a card and then formed into a web through a webber. The resulting webs are laminated to a desired weight and thickness, and then formed into a nonwoven fabric through fiber entanglement according to a known process such as a needle-punching process, a water-jet treatment process, etc. Alternatively, the staples are dispersed in water to prepare a sheet-making slurry, and the slurry is made into a nonwoven fabric. With that, the nonwoven fabric is laminated on a knitted or woven fabric, and is entangled with the thus-laminated, knitted or woven fabric with water jets, etc. applied thereto to thereby form a conjugate nonwoven fabric. Thus formed, the nonwoven fabric must have an intended shape corresponding to its object, while the thickness, etc. of the leather-like sheet to be formed from it is taken into consideration. Concretely, for example, it is desirable that the unit weight of the nonwoven fabric falls between 200 g/m$^2$ and 1500 g/m$^2$ and the thickness thereof falls between 1 mm and 10 mm, in view of the handlability thereof in the process of processing it.

If desired, the nonwoven fabric thus produced according to the method mentioned above may receive a polyvinyl alcohol size applied thereto, or the surfaces of the constituent fibers of the nonwoven fabric may be melted to thereby adhere the constituent fibers to each other for pre-setting the nonwoven fabric. Thus processed, the structure of the nonwoven fabric is prevented from being broken in the subsequent step of dipping it under tension in a polymer elastomer solution. In addition, the polymer elastomer applied to the thus-preset nonwoven fabric does not substantially adhere to the superfine fibers that constitute the nonwoven fabric, and therefore the nonwoven fabric can have a leather-like soft feel.

The nonwoven fabric is dipped in a dipping liquid prepared by dissolving or dispersing the polymer elastomer in a solvent or a dispersant, and then processed with a non-solvent for resin whereby the polymer elastomer having penetrated into the nonwoven fabric is solidified in wet to form a porous or non-porous polymer elastomer phase in the nonwoven fabric. Alternatively, the nonwoven fabric thus impregnated with the polymer elastomer is directly dried under heat to thereby gel the polymer elastomer into a porous polymer elastomer phase therein. The process gives a flame-retardant leather-like sheet substrate composed of the sea-island structured fibers and the polymer elastomer. If desired, the dipping liquid may contain some additives such as colorant, coagulation regulator, antioxidant, dispersant, etc.

Next, the sheet composed of the sea-island structured fibers and the polymer elastomer is processed with a chemical that serves as a non-solvent for the island component polymer and the polymer elastomer and as a solvent or a decomposing agent for the sea component polymer, whereby the sea-island structured fibers are converted into superfine fiber bundles. In case where a low-molecular flame retardant is added to the superfine fibers and the polymer elastomer for making them resistant to flames, the flame retardant may often flow away in the processing step. In the invention, however, the organophosphorus component in the superfine polyester fibers and the polymer elastomer is copolymerized with each polymer and enveloped therein, and therefore does not drop off at all from the polymer even in the processing step. On the other hand, when a metal hydroxide is added to the polymer elastomer, almost all of it remains in the polymer elastomer not readily dropping off therefrom; and when an organophosphorus component is copolymerized with the polymer elastomer, it does not drop off therefrom at all for the same reason as that for the superfine fibers mentioned above. The ratio of the polymer elastomer to remain in the flame-retardant leather-like sheet substrate from which the sea component has been removed preferably falls between 5% and 70% in terms of the solid content thereof by weight, more preferably between 10% and 50%. If the ratio of the polymer elastomer is smaller than 5%, it could not form a dense and porous polymer elastomer phase in the sheet substrate, and if so, the metal hydroxide particles will readily drop off from the sheet substrate in which the superfine fibers have been formed. On the other hand, if the ratio is larger than 70%, the flame-retardant leather-like sheet substrate obtained will have a rubber-like feel.

Thus fabricated, the flame-retardant leather-like sheet substrate comprises (1) a combination of the superfine fibers of an organophosphorus component-copolymerized polyester and the porous or non-porous polymer elastomer that carries a metal hydroxide therein, or (2) a combination of the superfine fibers of an organophosphorus component-copolymerized polyester and the porous or non-porous polymer elastomer copolymerized with an organophosphorus component.

It is difficult to theoretically verify the fact that the combinations are the most suitable to the invention. However, it is true that a combination of polyester fibers not containing a flame-retardant component and a metal hydroxide-carrying polymer elastomer, or a combination of superfine fibers of an organophosphorus component-copolymerized polyester and a polymer elastomer not containing a metal hydroxide could not give entirely flame-retardant leather-like sheet substrates even though the concentration of the flame retardant in any one of the constituent components is increased to the highest possible degree. In addition, it is also true that a combination of polyester fibers not containing a flame-retardant component and an organophosphorus component-containing polymer elastomer, or a combination of superfine fibers of an organophosphorus component-copolymerized polyester and a polymer elastomer not containing a flame-retardant component could not also give entirely flame-retardant leather-like sheet substrates even though the concentration of the flame retardant in any one of the constituent components is increased to the highest possible degree.

In multi-component materials like the leather-like sheet substrate of the invention, it is effective to add a flame-retardant component to each of the constituent elements for making them resistant to flames. Though its details could not be confirmed as yet, it is presumed that, in the case of the combination (1), the fire-resisting mechanism of the organophosphorus compound to form a carbide film and the fire-resisting mechanism of heat absorption of the metal hydroxide, especially that of more effective aluminium hydroxide will exhibit a synergistic effect for inhibiting firing in multiple places of the sheet substrate exposed to flames. On the other hand, the sheet of the combination (2) is entirely unified to have the same flame-retardant mechanism throughout it, and therefore it does not require any balance control for flame retardation that is necessary in a case having different flame-retardant mechanisms. Therefore, in the sheet of the type, the flame retardation can be well controlled only by controlling the concentration of the flame retardant therein. To that effect, the sheet of the type has an industrial advantage.

For applying a flame retardant to fibrous sheets, one general method comprises dipping the sheets in a flame retardant-containing liquid followed by drying them. In the method, however, when the fibers constituting the sheet are in the form of superfine fiber bundles and when the flame retardant is in the form of fine particles, the flame retardant could penetrate little into the depth of the superfine fiber bundles and almost all the flame retardant will exist only outside the fiber bundles and on the outer surface of the polymer elastomer combined with the fibers. In that condition, the flame retardant readily drops off from the sheets, and the sheets could not enjoy durable flame retardancy. For preventing the flame retardant from dropping off from the sheets, a method may be employable that comprises kneading the flame retardant into a binder resin followed by dipping sheets in the binder resin-containing liquid. Even in the method, however, the flame retardant could not still penetrate into the depth of the superfine fiber bundles, and, in addition, the sheets are also filled with the resin. Therefore, the method is defective in that the sheets processed therein lose their soft feel and could not be well napped. The present invention is free from these drawbacks of the method.

When the flame-retardant leather-like sheet substrate of the invention is napped on its surface, it gives suede-like artificial leather. In addition, the surface of the fibrous sheet may be melted and smoothed, or may be coated with resin. Further, it may be embossed to form a natural leather-like pattern thereon, and it may be grain type artificial leather.

Thus produced, the artificial leather has many applications for sundries such as shoes, bags, pouches, etc., for interior goods such as facing materials for sofas, etc., as well as clothing, etc. In particular, the flame-retardant leather-like sheet substrate of the invention is suitable to the use that requires flame retardancy and requires mechanical strength, for example to the use for facing materials for seats for vehicles, such as those for seats for automobiles, seats for railroad coaches, seats for airplanes, seats for ships, etc. The leather-like sheet substrate of the invention may be laminated with any other woven or knitted fabric or nonwoven fabric for reinforcing it. Preferably, the reinforcing fabric is resistant to flames.

The invention is described concretely with reference to the following Examples, to which, however, the invention is not limited. In the Examples, parts and % are all by weight unless otherwise specifically indicated. The fineness of the fibers and the mean particle size of the metal hydroxides used in the invention are determined according to the methods mentioned below. The flame retardancy of the samples produced in the Examples is evaluated according to the method also mentioned below. The following Examples 1, 2, 3, and 7 and Comparative Examples 1, 2, 3, 4, 6 and 7 have been performed while the remaining examples are hypothetical.

[Fineness of Fibers]: Fibers are observed with an electronic microscope of from 500 to 2000× or so, and the diameter of each fiber is measured. The data thus measured are converted into the fineness of the fibers.

[Mean Particle Size of Metal Hydroxide]: Measured through electronic microscopic observation.

[Method of Flame Retardancy Test] According to the combustion test method of JIS D1201 for organic materials for upholstery for automobiles, the samples are tested and grouped into the following three groups:

Readily flammable: When fired, its fire-spreading speed is over 100 mm/min.

Hardly flammable: When fired, its fire-spreading speed is not over 100 mm/min.

Self-extinguishing: When fired, it is self-extinguished within 50 mm from the marked line and within 60 seconds.

The phosphorus atom concentration in each sample of the Examples is measured with an ICP emission spectrophotometer, IRIS AP (from Jarrell-Ash).

EXAMPLES 1 AND 2

According to a known polymerization method for polyester, a phosphorus-containing flame retardant M-Ester (from Sanko, having a molecular weight of 434 and a phosphorus content of 7% by weight) was added to the polymerization system to obtain two different types of phosphorus-containing flame retardant-copolymerized polyethylene terephthalate-type polyesters having a phosphorus atom concentration of 5000 ppm or 12000 ppm.

Using the phosphorus-containing flame retardant-copolymerized polyester for the island component and a high-flowability low-density polyethylene for the sea component, sea-island structured bi-component fibers were melt-spun (sea component/island component=35/65; number of islands 16). The stretching draw ratio was 2.5 times in hot water at 70° C., to which was applied an oily agent for fibers. These were mechanically crimped and dried, and then cut into 5.0 dtex stable fibers each having a length of 51 mm. In a cross-lap method, these were formed into a web having a unit weight of 650 g/m$^2$. Thus formed, two webs were alternately combined and needle-punched through the two surfaces thereof to a pitch of about 2500 punches/cm$^2$. This was heated, and then pressed while cooled between cooling rolls to give an entangled nonwoven fabric having a smooth surface. The unit weight of the entangled nonwoven fabric was 1200 g/m$^2$, and the apparent density thereof was 0.48 g/cm$^3$. The entangled nonwoven fabric was dipped in a dipping liquid that had been prepared by adding 17.5 parts of a 40% dispersion in dimethylformamide (DMF) of aluminium hydroxide having a mean particle size of 1 μm to 100 parts of a 14% (solid content) solution in DMF of polyurethane of essentially a polycarbonate-type polyurethane (polyurethane/aluminium hydroxide=100/50). Thus dipped therein, the nonwoven fabric was further dipped in a mixture of DMF/water and then set in wet. In hot toluene, the sea component was dissolved out and removed from the sea-island structured bi-component fibers that constitute the nonwoven fabric to thereby form superfine fibers. The process gave a flame-retardant leather-like sheet substrate having a thickness of 1.3 mm.

The mean fineness of the superfine fibers was 0.2 dtex. The ratio by weight of the fibers in the leather-like sheet substrate to the polyurethane therein was about 8/2. The cross sections of the fibers constituting the leather-like sheet substrate obtained herein were observed with a microscope, and it was confirmed that many aluminium hydroxide particles exist inside the porous polymer elastomer in the sheet substrate. The test data of the flame retardancy and the phosphorus atom concentration of the leather-like sheet substrates obtained herein are given in Table 1. The sheet surface was napped and dyed with a disperse dye to give suede-like artificial leather. Its flame retardancy was excellent, and its feel was soft. The suede-like artificial leather thus obtained herein is suitable to the use in the interior field that requires flame retardancy, especially to seats for vehicles, etc.

Not being napped, the surface of the sheet substrate was coated with a polyurethane layer having a thickness of 60 μm, then embossed to have a natural leather-like pattern, and crumpled. The process gave grain type artificial leather having a soft feel. Like that obtained in the above, its flame retardancy was excellent and this is suitable to the use in the interior field that requires flame retardancy, especially to seats for vehicles, etc. Even after the finish treatment, the artificial leather was still self-extinguishable in the combustion test of JIS D1201.

The suede-like or grain type artificial leather thus obtained herein was used in actually fabricating car seats, and the car seats thus fabricated were all free from the working problem to be caused by the mechanical strength of the artificial leather used. In fact, the feel and the outward appearance of the car seats fabricated herein were almost the same as those of car seats with natural leather, and the flame retardancy thereof was good.

EXAMPLES 3 AND 4

Leather-like sheet substrates, and suede-like or grain type artificial leather were produced under the same conditions as in Examples 1 and 2, for which, however, used was 130 parts of magnesium hydroxide having a mean particle size of 1 μm in place of aluminium hydroxide for the flame retardant to be added to the polymer elastomer. The suede-like or grain type artificial leather thus obtained herein was used in actually fabricating car seats, and the car seats thus fabricated were all free from the working problem to be caused by the mechanical strength of the artificial leather used. In fact, the feel and the outward appearance of the car seats fabricated herein were almost the same as those of car seats with natural leather, and the flame retardancy thereof was good. The test data of the flame retardancy and the phosphorus atom concentration of the leather-like sheet substrates obtained herein are given in Table 1.

EXAMPLES 5 AND 6

Leather-like sheet substrates were produced under the same conditions as in Examples 1 and 2, for which, however, used was trimethylene glycol for the essential glycol component. Suede-like or grain type artificial leather formed from the sheet substrates was used in actually fabricating car seats, and the car seats thus fabricated were all free from the working problem to be caused by the mechanical strength of the artificial leather used. In fact, the feel and the outward appearance of the car seats fabricated herein were almost the same as those of car seats with natural leather, and the flame retardancy thereof was good. The test data of the flame retardancy and the phosphorus atom concentration of the leather-like sheet substrates obtained herein are given in Table 2.

COMPARATIVE EXAMPLE 1

A leather-like sheet substrate was produced under the same condition as in Example 1, for which, however, used was a polyethylene terephthalate-type polyester not copolymerized with a phosphorus-containing flame-retardant component for the island component. The test data of the flame retardancy and the phosphorus atom concentration of the leather-like sheet substrate obtained herein are given in Table 1.

COMPARATIVE EXAMPLES 2 AND 3

Leather-like sheet substrates were produced under the same conditions as in Examples 1 and 2, for which, however, aluminium hydroxide was not added to the polymer elastomer. The test data of the flame retardancy and the phosphorus atom concentration of the leather-like sheet substrates obtained herein are given in Table 1.

COMPARATIVE EXAMPLE 4

A leather-like sheet substrate was produced under the same condition as in Example 1, for which, however, used were sea-island fibers prepared by kneading a low-molecular phosphorus-containing flame retardant into the island component. The test data of the flame retardancy and the phosphorus atom concentration of the leather-like sheet substrate obtained herein are given in Table 1.

EXAMPLES 7 AND 8

According to a known polymerization method for polyester, a phosphorus-containing flame retardant M-Ester (from Sanko, having a molecular weight of 434 and a phosphorus content of 7% by weight) was added to the polymerization system to obtain two different types of phosphorus-containing flame retardant-copolymerized polyethylene terephthalate-type polyesters having a phosphorus atom concentration of 5000 ppm or 12000 ppm.

Using the phosphorus-containing flame retardant-copolymerized polyester for the island component and a high-flowability low-density polyethylene for the sea component, sea-island structured bi-component fibers were melt-spun (sea component/island component=35/65; number of islands 16). The stretching draw ratio was 2.5 times in hot water at 70° C., to which was applied an oily agent for fibers. These were mechanically crimped and dried, and then cut into 5.0 dtex stable fibers each having a length of 51 mm. In a cross-lap method, these were formed into a web having a unit weight of 650 g/m$^2$. Thus formed, two webs were alternately combined and needle-punched through the two surfaces thereof to a pitch of about 2500 punches/cm$^2$. This was heated, and then pressed while cooled between cooling rolls to give an entangled nonwoven fabric having a smooth surface. The unit weight of the entangled nonwoven fabric was 1200 g/m$^2$, and the apparent density thereof was 0.48 g/cm$^3$.

On the other hand, a polymer elastomer solution in which the nonwoven fabric is to be dipped was prepared in the manner mentioned below.

8.2 parts by weight of a tertiary amino group-having diol, N-methyldiethanolamine; 236.1 parts by weight of polyhexylene carbonate having a number-average molecular weight of 2000, 40.3 parts by weight of polybutylene adipate having a number-average molecular weight of 2000 and 44.0 parts by weight of polytetramethylene glycol having a number-average molecular weight of 2000, to be a polymer diol component; 28.9 parts by weight of an organic diisocyanate, hexane diisocyanate; and 105.9 parts by weight of DMF were put into a reactor, and reacted in a nitrogen atmosphere at a predetermined temperature for a predetermined period of time to obtain an intermediate. After the presence of no isocyanate group therein was confirmed, the intermediate was analyzed through GPC to measure its weight-average molecular weight, which was 40,000.

To the DMF solution of the intermediate diol prepared in the above, added were 18.2 parts by weight of a low-molecular diol, ethylene glycol, 21.8 parts by weight of PO-4500 (from Nippon Chemical Industrial, having a molecular weight of 222.26 and a phosphorus content of 13.9% by weight) and 112.6 parts by weight of diphenylmethane-4,4'-diisocyanate, and reacted to give a polyurethane solution having a concentration of 25% and a weight-average molecular weight of 320,000. To 100 parts by weight of the thus-obtained polyurethane solution, added was 78 parts by weight of DMF to give a dipping liquid having a solid content of 14%.

The entangled nonwoven fabric prepared in the above was dipped in the dipping liquid. Thus dipped therein, the nonwoven fabric was further dipped in a mixture of DMF/water and then set in wet. In hot toluene, the sea component was dissolved out and removed from the sea-island structured bi-component fibers that constitute the nonwoven fabric to thereby form superfine fibers. The process gave a flame-retardant leather-like sheet substrate having a thickness of 1.30 mm. The mean fineness of the superfine fibers was 0.2 dtex. The ratio by weight of the fibers in the leather-like sheet substrate to the polyurethane therein was about 8/2. The test data of the flame retardancy and the phosphorus atom concentration of the leather-like sheet substrates obtained herein are given in Table 2.

The sheet surface was napped and dyed to give suede-like artificial leather. Its dyeability and its flame retardancy were both excellent, and its feel was soft. The suede-like artificial leather thus obtained herein is suitable to the use in the interior field that requires flame retardancy, especially to seats for vehicles, etc.

Not being napped, the surface of the sheet substrate was coated with a polyurethane layer having a thickness of 60 μm, then embossed to have a natural leather-like pattern, and crumpled. The process gave grain type artificial leather having a soft feel. Like that obtained in the above, its flame retardancy was excellent and this is suitable to the use in the interior field that requires flame retardancy, especially to seats for vehicles, etc. Even after the finish treatment, the artificial leather was still self-extinguishable in the combustion test of JIS D1201. In addition, even after dipped in hot water at 90° C. for 30 days, the artificial leather was still resistant to flames.

The suede-like or grain type artificial leather thus obtained herein was used in actually fabricating car seats, and the car seats thus fabricated were all free from the working problem to be caused by the mechanical strength of the artificial leather used. In fact, the feel and the outward appearance of the car seats fabricated herein were almost the same as those of car seats with natural leather, and the flame retardancy thereof was good.

EXAMPLES 9 AND 10

Leather-like sheet substrates were produced under the same conditions as in Examples 7 and 8, for which, however, used was polyether diol in place of polyhexylene carbonate for the polymer diol. Suede-like or grain type artificial leather formed from the sheet substrates was used in actually fabricating car seats, and the car seats thus fabricated were all free from the working problem to be caused by the mechanical strength of the artificial leather used. In fact, the feel and the outward appearance of the car seats fabricated herein were almost the same as those of car seats with natural leather, and the flame retardancy thereof was good. The test data of the flame retardancy and the phosphorus atom concentration of the leather-like sheet substrates obtained herein are given in Table 2.

EXAMPLES 11 AND 12

Leather-like sheet substrates were produced under the same conditions as in Examples 7 and 8, for which, however, used was polyester diol in place of polyhexylene carbonate for the polymer diol. Suede-like or grain type artificial leather formed from the sheet substrates was used in actually fabricating car seats, and the car seats thus fabricated were all free from the working problem to be caused by the mechanical strength of the artificial leather used. In fact, the feel and the outward appearance of the car seats fabricated herein were almost the same as those of car seats with natural leather, and the flame retardancy thereof was good. The test data of the flame retardancy and the phosphorus atom concentration of the leather-like sheet substrates obtained herein are given in Table 2.

EXAMPLES 13 AND 14

Leather-like sheet substrates were produced under the same conditions as in Examples 7 and 8, for which, however, used was trimethylene glycol for the essential glycol component. Suede-like or grain type artificial leather formed from the sheet substrates was used in actually fabricating car seats, and the car seats thus fabricated were all free from the working problem to be caused by the mechanical strength of the artificial leather used. In fact, the feel and the outward appearance of the car seats fabricated herein were almost the same as those of car seats with natural leather, and the flame retardancy thereof was good. The test data of the flame retardancy and the phosphorus atom concentration of the leather-like sheet substrates obtained herein are given in Table 2.

COMPARATIVE EXAMPLE 5

A leather-like sheet substrate was produced under the same condition as in Example 7, for which, however, used was a polyethylene terephthalate-type polyester not copolymerized with a phosphorus-containing flame-retardant component for the island component. The test data of the flame retardancy and the phosphorus atom concentration of the leather-like sheet substrate obtained herein are given in Table 2.

COMPARATIVE EXAMPLES 6 AND 7

Leather-like sheet substrates were produced under the same conditions as in Examples 7 and 8, for which, however, an organophosphorus flame-retardant component was not added to the polymer elastomer in producing it. The test data of the flame retardancy and the phosphorus atom concentration of the leather-like sheet substrates obtained herein are given in Table 2.

INDUSTRIAL APPLICABILITY

The leather-like sheet substrate of the invention is free from halogen and has good flame retardancy, and, in addition, the durability of its flame retardancy is extremely excellent. Further, the leather-like sheet substrate of the invention has a leather-like soft feel and is extremely favorable for the substrate layer for suede-like or grain type artificial leather, and it is suitable to applications that require flame retardancy, for example, to the facing materials for seats for automobiles, seats for railroad coaches, seats for airplanes, sofas, etc. Moreover, the leather-like sheet substrate of the invention has many other general applications in addition to applications of ordinary artificial leather, for example, for wallpapers, carpets, etc.

TABLE 1

| | Island Component, and Phosphorus Atom Concentration in Island Component (in raw fibers just after spun) [ppm] | Phosphorus Atom Concentration in Island Component (in sheet substrate) [ppm] | Amount of Metal Hydroxide Added (relative to polymer elastomer) [phr] | Combustion Test JIS D1201 |
|---|---|---|---|---|
| Example 1 | polyethylene terephthalate, $5 \times 10^3$ | $5 \times 10^3$ | aluminium hydroxide 50 | self-extinguishable |
| Example 2 | polyethylene terephthalate, $12 \times 10^3$ | $12 \times 10^3$ | aluminium hydroxide 50 | self-extinguishable |
| Example 3 | polyethylene terephthalate, $5 \times 10^3$ | $5 \times 10^3$ | magnesium hydroxide 130 | hardly flammable |
| Example 4 | polyethylene terephthalate, $12 \times 10^3$ | $12 \times 10^3$ | magnesium hydroxide 130 | self-extinguishable |
| Example 5 | polytrimethylene terephthalate, $5 \times 10^3$ | $5 \times 10^3$ | aluminium hydroxide 50 | self-extinguishable |
| Example 6 | polytrimethylene terephthalate, $12 \times 10^3$ | $12 \times 10^3$ | aluminium hydroxide 50 | self-extinguishable |
| Comp. Example 1 | polyethylene terephthalate, 0 | 0 | aluminium hydroxide 50 | readily flammable |
| Comp. Example 2 | polyethylene terephthalate, $5 \times 10^3$ | $5 \times 10^3$ | 0 | readily flammable |
| Comp. Example 3 | polyethylene terephthalate, $12 \times 10^3$ | $12 \times 10^3$ | 0 | readily flammable |

TABLE 1-continued

| | Island Component, and Phosphorus Atom Concentration in Island Component (in raw fibers just after spun) [ppm] | Phosphorus Atom Concentration in Island Component (in sheet substrate) [ppm] | Amount of Metal Hydroxide Added (relative to polymer elastomer) [phr] | Combustion Test JIS D1201 |
|---|---|---|---|---|
| Comp. Example 4 | polyethylene terephthalate, $5 \times 10^3$ | $1 \times 10^3$ | aluminium hydroxide 50 | readily flammable |

TABLE 2

| | Island Component, and Phosphorus Atom Concentration in Island Component (in raw fibers just after spun) [ppm] | Essential Ingredient of Polyurethane | Phosphorus Atom Concentration in Polyurethane (in solid) [ppm] | Combustion Test JIS D1201 |
|---|---|---|---|---|
| Example 7 | polyethylene terephthalate, $5 \times 10^3$ | Polycarbonate | $5 \times 10^3$ | self-extinguishable |
| Example 8 | polyethylene terephthalate, $12 \times 10^3$ | Polycarbonate | $5 \times 10^3$ | self-extinguishable |
| Example 9 | polyethylene terephthalate, $5 \times 10^3$ | Polyether | $5 \times 10^3$ | self-extinguishable |
| Example 10 | polyethylene terephthalate, $12 \times 10^3$ | Polyether | $5 \times 10^3$ | self-extinguishable |
| Example 11 | polyethylene terephthalate, $5 \times 10^3$ | Polyester | $5 \times 10^3$ | self-extinguishable |
| Example 12 | polyethylene terephthalate, $12 \times 10^3$ | Polyester | $5 \times 10^3$ | self-extinguishable |
| Example 13 | polytrimethylene terephthalate, $5 \times 10^3$ | Polycarbonate | $5 \times 10^3$ | self-extinguishable |
| Example 14 | polytrimethylene terephthalate, $12 \times 10^3$ | Polycarbonate | $5 \times 10^3$ | self-extinguishable |
| Comp. Example 5 | polyethylene terephthalate, 0 | Polycarbonate | $5 \times 10^3$ | readily flammable |
| Comp. Example 6 | polyethylene terephthalate, $5 \times 10^3$ | Polycarbonate | 0 | readily flammable |
| Comp. Example 7 | polyethylene terephthalate, $12 \times 10^3$ | Polycarbonate | 0 | readily flammable |

The invention claimed is:

1. A flame-retardant artificial leather sheet substrate, comprising:

a nonwoven fabric of three-dimensionally entangled superfine fibers (A) of at most 0.5 dtex in fineness, and a polymer elastomer (B) filled in the nonwoven fabric, wherein the superfine fibers (A) comprise an organophosphorus component-copolymerized polyester and the polymer elastomer (B) satisfies at least one of the following (1) or (2):

(1) the polymer elastomer (B) contains a metal hydroxide;

(2) the polymer elastomer (B) is copolymerized with an organophosphorus component, and wherein said flame retardant artificial leather sheet substrate has a fire spreading speed of not more than 100 mm/min. as measured in the combustion test method of JIS D1201.

2. The flame-retardant artificial leather sheet substrate as claimed in claim 1, wherein the metal hydroxide is a hydroxide of at least one metal selected from a group consisting of aluminium and magnesium.

3. The flame-retardant artificial leather sheet substrate as claimed in claim 1, wherein the metal hydroxide is aluminium hydroxide.

4. The flame-retardant artificial leather substrate as claimed in claim 1, wherein the superfine fibers (A) comprise an organophosphorus component-copolymerized with polyethylene terephthalate, an organophosphorus component-copolymerized with modified polymers of polyethylene terephthalate, an organophosphorus component-copolymerized with mixed polymers of polyethylene terephthalate with any other polyesters, or an organophosphorus component-copolymerized with copolymers of polyethylene terephthalate with any other polyesters.

5. The flame-retardant artificial leather sheet substrate as claimed in claim 1, wherein the superfine fibers (A) comprise an organophosphorus component-copolymerized with polytrimethylene terephthalate, an organophosphorus component-copolymerized with modified polymers of polytrimethylene terephthalate, an organophosphorus component-copolymerized with mixed polymers of polytrimethylene terephthalate with any other polyesters, or an organophosphorus component-copolymerized with copolymers of polytrimethylene terephthalate with any other polyesters.

6. The flame-retardant artificial leather sheet substrate as claimed in claim 3, wherein the phosphorus atom concentration in the organophosphorus component-copolymerized polyester is from 3000 ppm to 20000 ppm and the amount of aluminium hydroxide in the polymer elastomer (B) is from 10 parts by weight to 200 parts by weight relative to 100 parts by weight of the polymer elastomer (B).

7. The flame-retardant artificial leather sheet substrate as claimed in claim 1, wherein the polymer elastomer (B) to be copolymerized with an organophosphorus component is a polyurethane resin.

8. The flame-retardant artificial leather sheet substrate as claimed in claim 7, wherein the polyurethane is the polymer elastomer comprising polycarbonate polyurethanes alone or a mixture of polycarbonate polyurethane with any other polymer elastomers.

9. The flame-retardant artificial leather sheet substrate as claimed in claim 1, wherein the phosphorus atom concentration in the organophosphorus component-copolymerized polyester is from 3000 ppm to 20000 ppm, the polymer elastomer (B) is an organophosphorus component-copolymerized polycarbonate-type polyurethane, and the phosphorus atom concentration in the polyurethane is at least 3000 ppm.

10. Artificial suede leather that comprises the substrate of claim 1.

11. Grained artificial leather that comprises the substrate of claim 1.

12. Seats for vehicles of which one or more pieces of the facing material is made of the artificial leather of claim 10.

13. A method for producing a flame-retardant artificial leather sheet substrate, comprising: the following steps <1> to <3> to be effected in an order of <1>, <2> and <3> or an order of <1>, <3> and <2>:

<1> preparing a fibers-entangled nonwoven fabric that comprises superfine fibers-forming fibers capable of giving superfine fibers (A) of an organophosphorus component-copolymerized polyester, <2> applying to the nonwoven fabric a polymer elastomer (B) that contains a metal hydroxide or is copolymerized with an organophosphorus component, <3> converting the superfine fibers-forming fibers into bundles of superfine fibers (A) having a single-fiber fineness of at most 0.5 dtex;

wherein the flame-retardant artificial leather sheet substrate comprises the nonwoven fabric of three-dimensionally entangled superfine fiber (A) of at most 0.5 dtex in fineness, and the polymer elastomer (B) filled in the nonwoven fabric, and wherein said flame retardant artificial leather sheet substrate has a fire spreading speed of not more than 100 mm/min. as measured in the combustion test method of JIS D 1201.

14. Seats for vehicles of which one or more pieces of the facing material is made of the artificial leather of claim 11.

15. The flame-retardant artificial leather sheet substrate as claimed in claim 1, which, when fired, is self-extinguished within 50 mm from a marked line and within 60 seconds.

* * * * *